United States Patent [19]

Fuchs

[11] 4,443,194

[45] Apr. 17, 1984

[54] DENTAL OPERATING UNIT WITH REVERSIBLE DENTAL ASSISTANT'S UNIT

[75] Inventor: John R. Fuchs, Louisville, Ky.

[73] Assignee: Robert J. Fuchs, Louisville, Ky.

[21] Appl. No.: 392,853

[22] Filed: Jun. 28, 1982

[51] Int. Cl.[3] ..... A61G 1/14; A61G 15/00

[52] U.S. Cl. ..... 433/79

[58] Field of Search ..... 433/77, 78, 79

[56] References Cited

U.S. PATENT DOCUMENTS 3,455,620 7/1969 Coburn ..... 433/77
3,530,513 9/1970 Maurer et al. ..... 433/77

FOREIGN PATENT DOCUMENTS 877196 8/1971 Canada ..... 433/77
1138294 12/1968 United Kingdom ..... 433/77

OTHER PUBLICATIONS

"Dentsply Presents the Spectrum", publication Jan. 1973, Dentsply International, York, Pa.

*Primary Examiner*—Robert Peshock
*Attorney, Agent, or Firm*—Richard L. Caslin

[57] ABSTRACT

A dental operating unit is shown for use behind the head of a reclining patient's chair. There is a central, floor-mounted dentist's dynamic instrument service cabinet and an elongated counter top that is elevated above the service cabinet a short distance thereby leaving a gap between the cabinet and the counter top, and there is a pair of pivoted bracket arms located within the gap above the service cabinet and beneath the counter top. One pivot bracket arm has an anchor pivot that supports the bracket arms, while the free end of the second bracket arm is attached to a dental assistant's unit; whereby this dental assistant's unit is supported by a pair of swinging bracket arms which are capable of moving so that the dental assistant's unit may be reversible from either the left side or the right side of the patient's chair. These pivoted bracket arms may include one or more of the following utilities: electrical cable means, vacuum conduit means, water conduit means and compressed air conduit means for supplying the dynamic instruments that are used by the dental assistant. A sink unit may be mounted to each side of this dental operating unit.

6 Claims, 8 Drawing Figures

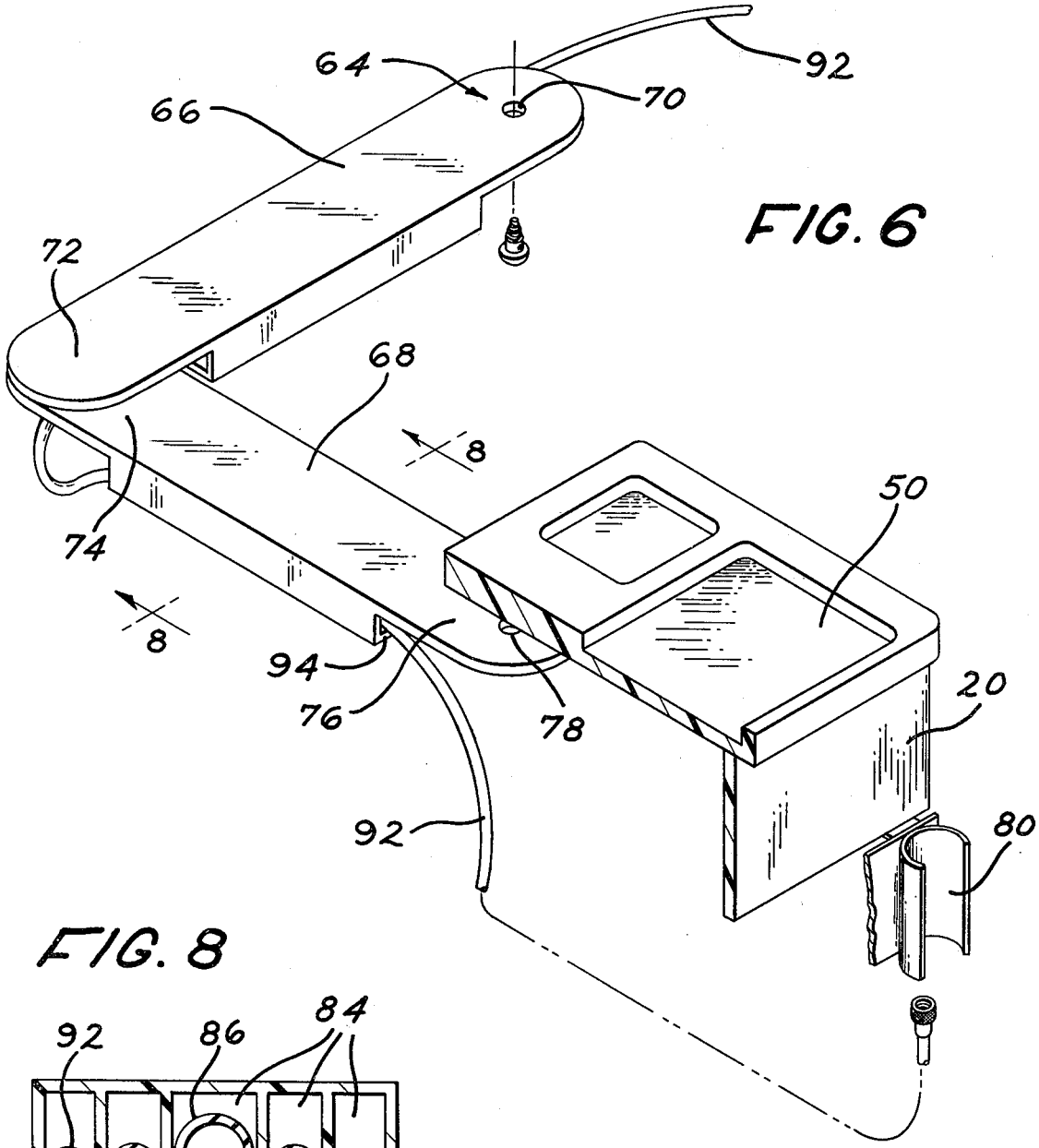
FIG. 6
FIG. 8
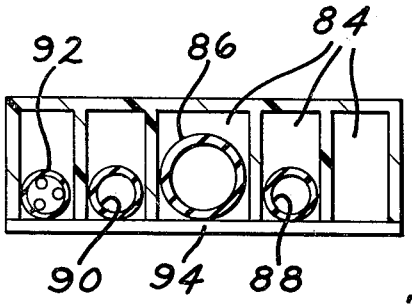
FIG. 7
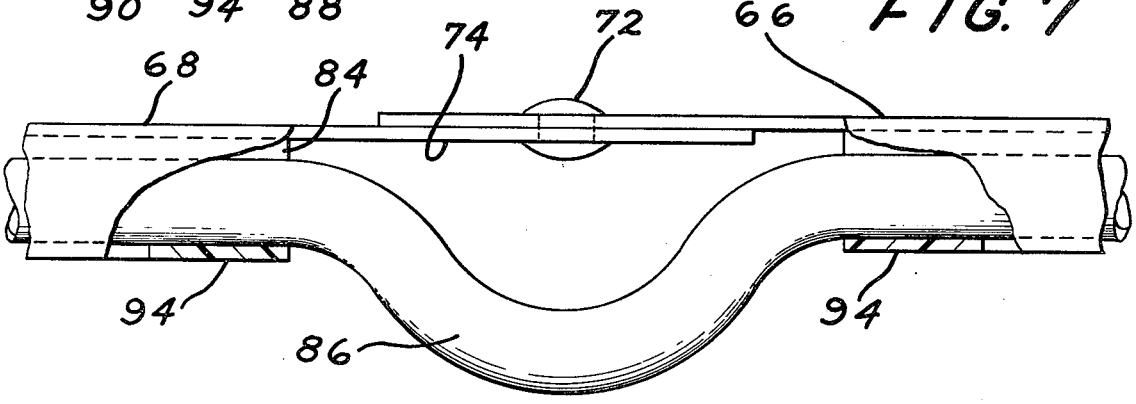

DENTAL OPERATING UNIT WITH REVERSIBLE DENTAL ASSISTANT'S UNIT

BACKGROUND OF THE INVENTION

1. Field of the Invention

This invention relates to dental operating equipment, and particularly to interchangeable equipment for use by the Dental Assistant so that she may operate from either side of the patient's chair, depending upon whether the dentist is right-handed or left-handed.

2. Description of the Prior Art

The Horowitz et al. U.S. Pat. No. 3,304,609 describes a dental equipment stand which is capable of both vertical and rotational movement relative to its mounting means, as well as having a motor-driven, horizontally-movable, floor-mounted support for imparting horizontal movement to the hollow column and instrument head relative to the dental chair.

The Junkel et al. U.S. Pat. No. 3,348,799 describes a vertically-adjustable dental tray assembly which is motor operated and has a pair of swinging arms that support a dental tray.

The Coburn U.S. Pat. No. 3,455,620 describes dental operating units with a waist-high, horizontal counter having the hand pieces located adjacent its front edge, with a control panel immediately above it, while the operating units for the hand pieces are disposed in a compartment at eye level to a standing dentist. There is a movable drawer storage unit mounted on wheels that can be shifted around at will, but it does not include electrical, hydraulic and vacuum systems, as are needed by the Dental Assistant.

The Maurer et al. U.S. Pat. No. 3,530,513 describes a horizontally-sliding support for a dental bowl unit.

The Wolf et al. U.S. Pat. No. 4,002,382 describes cabinet structure for a dental treatment room, and primarily a mobile cabinet. There is an arm that carries a tray that is usable for dental hand instruments and slow speed hand pieces. An extendible and contractible second arm which moves up, down, side-to-side is attached to an upright support and has connected at its outer end a holder for dental high-speed air turbines and air-water syringe.

The Burton U.S. Pat. No. 3,089,741 interconnects the equipment cabinet and the patient's chair for simultaneous vertical movement under the control of the dentist.

The Borgelt et al. U.S. Pat. No. 3,986,263 describes a dental instrument delivery system comprising a pair of dental units individually mounted on swivels under the head of the patient who is reclining in the dental chair.

OBJECTS OF THE PRESENT INVENTION

The principal object of the present invention is to provide a dental operating unit which has a dynamic instrument service cabinet in combination with a reversible dental assistant's unit supported from a disappearing movable support means so that the dental assistant may function successfully from either side of the patient's chair.

A further object of the present invention is to provide a dental operating unit of the class described where pivot bracket arm means that support the dental assistant's unit are also furnished with one or more of the following utilities: electrical cable means, vacuum conduit means, water conduit means and compressed air conduit means for supplying the dynamic instruments that are used by the dental assistant.

A still further object of the present invention is to provide a dental operating unit with a counter top that is elevated above a dentist's dynamic instrument storage cabinet to leave a gap in which the pivoted bracket arm means may travel when the dental assistant's unit is moved from one side to the other of the patient's chair.

SUMMARY OF THE PRESENT INVENTION

The present invention provides a dental assistant's unit that has a dentist's dynamic instrument service cabinet and an elongated counter top that is elevated above this service cabinet to provide a gap for accommodating a pivoted bracket arm means which is anchored at one end under the counter top and supports the dental assistant's unit at the opposite end so that the dental assistant's unit may be moved from one side of the patient's chair to the other. The pivoted bracket arm means is hollow so as to accommodate one or more of the following utilities: electrical cable means, vacuum conduit means, water conduit means and compressed air conduit means for supplying the dynamic instruments used by the dental assistant.

BRIEF DESCRIPTION OF THE DRAWINGS

This invention will be better understood from the following description taken in conjunction with the accompanying drawings, and its scope will be pointed out in the appended claims.

FIG. 6 is a perspective view, on a larger scale, of the pair of pivoted bracket arms which serve to support the dental assistant's unit, with portions broken away in order to view details of construction.

FIG. 7 is a fragmentary, side elevational view of the central pivot of the pair of pivoted bracket arms of FIG.

6, except the bracket arms are arranged in a straight line relationship.

FIG. 8 is a transverse, cross-sectional view of one of the bracket arms, taken on the line 8—8 of FIG. 6.

DESCRIPTION OF THE PREFERRED EMBODIMENTS

Figure 1:
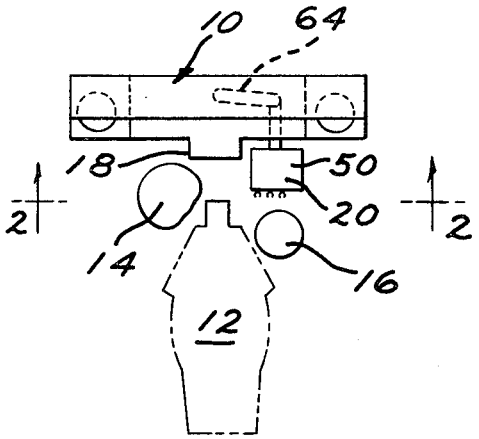
FIG. 1 shows a top plan view of a dental treatment room showing a reclining patient's chair in dotted lines and the dental operating unit of the present invention located at the head of the chair, and showing a central dentist's dynamic instrument service cabinet, and the doctor's stool at the left and the dental assistant's stool at the right with the dental assistant's unit also positioned at the right side of the chair.

Turning now to a consideration of the drawings, and, in particular, to the top plan view of FIG. 1, there is shown a dental operating unit 10 embodying the present invention. This unit is a rear delivery system for use adjacent the head of a reclining patient's chair 12. The doctor's stool 14 is shown at the left side of the chair, while the dental assistant's stool 16 is at the right side of the chair. The dentist's dynamic instrument service cabinet 18 is shown directly behind the head of the patient's chair. Shown near the dental assistant's stool 16 is the dental assistante's tray unit 20. This arrangement, as first discussed, is generally the layout of a typical dentist's operating office, where the dentist is right-handed. As a general rule, these dental operating units are designed to accommodate right-handed operators. Upon special request, some manufacturers will make their units for use by left-handed operators. However, these operating units have fixed modules, and a right-handed unit, as shown in FIG. 1, cannot be used comfortably by a left-handed operator, and the reverse is also true.

Approximately 21 percent of the population are left-handed, and this means that approximately 21 percent of the dentists are left-handed. In group practices, at military bases, dental schools, and retail dental centers, it is necessary for the owners, in most cases, to set up the operatories with fixed dental units that are either right-handed or left-handed. This causes a duplication of equipment and makes it necessary for the supporting personnel to place the right-handed operator's patients in operating rooms that can only be used by right-handed dentists, and the patients of the left-handed operators in another area designated to be used only by the left-handed operators. This is complicated and inefficient. The present invention was developed to create a universal dental operating unit which will accommodate either left-handed or right-handed operators by making it possible to reverse the position of the dental assistant's unit from one operating position to the other.

Figure 2:
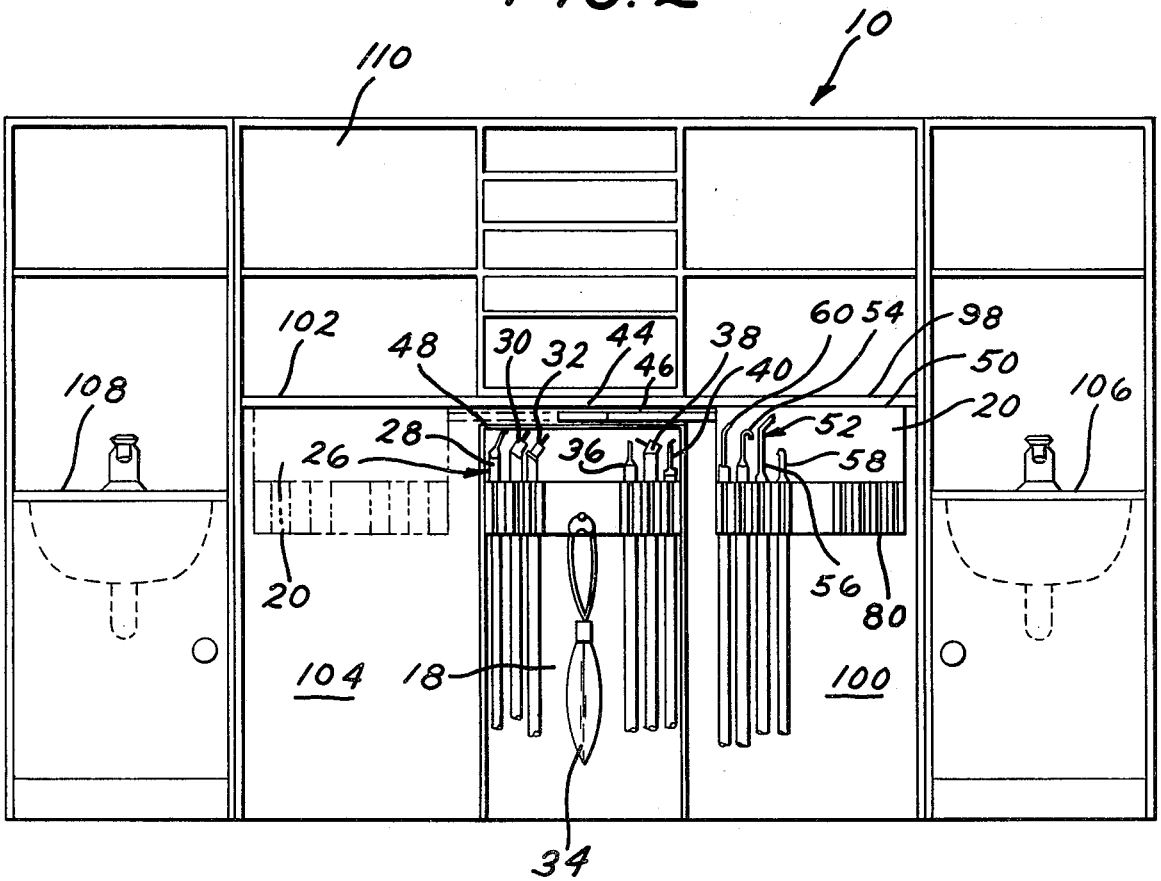
FIG. 2 is a front, elevational view, on a larger scale, of the dental operating unit, as shown in FIG. 1, taken on the lines 2—2 of FIG. 1, showing the dental assistant's unit in full lines at the right side, and this same dental assistant's unit is shown at the left side in dotted line position; thereby showing the two reversible positions of the dental assistant's unit relative to the central dentist's dynamic instrument service cabinet.

Now turning to a consideration of the front elevational view of FIG. 2, which is on a larger scale, the central element of this unit is the dentist's dynamic instrument service cabinet 18. It is furnished with a plurality of dynamic instruments 26, which are shown supported on the front side thereof, and they may vary in nature, depending upon the preferences of the dentist and his type of practice, as well as the variety of instruments available from the manufacturer who supplies this dental operating unit. It will suffice to merely name typical instruments that may be available, such as Cavitron 28, Hi-Speed Mini Drill 30, Hi-Speed Drill 32, Flowmeter 34, Lo-Speed Drill 36, Hi-Speed Drill 38 and Electrosurge 40.

Elevated above this central service cabinet 18 is a counter top 44 which leaves gap 46 between the top 48 of the service cabinet 18 and the underside of the counter top 44. Positioned to the right side of the central service cabinet 18, shown in full lines, is the dental assistant's unit 20, which is the position that it is shown in FIG. 1. This dental assistant's unit 20 has a tray 50 on the top side thereof, and a pluraltiy of dynamic instruments 52 supported on the front side thereof. These dynamic instruments 52 may vary, depending upon the preference of the dentist and the dental assistant, but typical instruments would be one or more of the following: a vacuum instrument 54 to remove the patient's saliva and any foreign matter from the patient's mouth, a water nozzle 56, a compressed air nozzle 58, and possibly an electric drill 60. Notice that the dentist's central dynamic instrument service cabinet 18 is shown as a floor-mounted unit, and that the dental assistant's unit 20 is a suspended unit off the floor. The service cabinet 18 could be hung on the back wall of the operating unit 10, rather than supported from the floor, without departing from the present invention.

Figure 3:
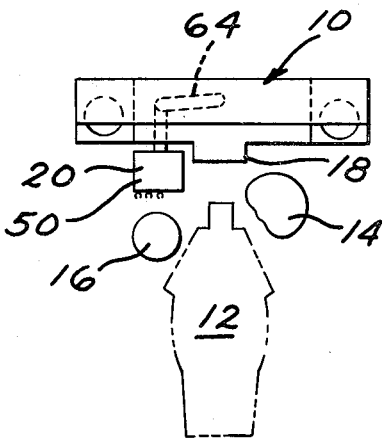
FIG. 3 is a top plan view, similar to that of FIG. 1, showing the doctor's stool moved to the right side and the dental assistant's stool moved to the left side of the chair, as well as the dental assistant's unit shifted to the left side.

Now looking at the top plan view of FIG. 3, it should be noted that the doctor's stool 14 has been moved to the right side of the patient's chair 12, and, similarly, the dental assistant's stool 16 has been transferred over to the left side of the chair. This would be the preferred arrangement if the doctor is left-handed. Also note that the dental assistant's tray unit 20 has been shifted from the right side to the left side so as to be readily accessible to the dental assistant. Shown in dotted lines, in both FIGS. 1 and 3, is a movable support means 64 for supporting the dental assistant's unit 20. The preferred embodiment of this movable support means 64 comprises a pair of pivoted bracket arms 66 and 68, as is best seen in FIG. 6. The first arm 66 has an anchor pivot 70 at one end for coupling with a heavy-duty bracket member (not shown) that would be supported either on the top 48 of the service cabinet 18 or on the underside of the counter top 44. The opposite end of the first arm 66 is provided with a pivot pin 72 for cooperation with a mating end 74 of the second arm 68 so as to establish a pivotal connection between the two bracket arms 66 and 68. The opposite end 76 of the second bracket arm 68 has a pivot bearing 78 for connection to the rear portion of the dental assistant's unit 20, so that this unit is pivotally suspended from the bracket arm 68. Notice the tray 50 that is positioned on the top of the dental assistant's unit 20 in FIG. 6. Also notice the clamp member 80 on the front side of the unit 20 for receiving the dynamic instruments 52 which were described with relation to FIG. 2. The swinging nature of this pair of bracket arms 66 and 68 can best be understood by studying the two top plan views of FIGS. 1 and 2. These bracket arms 66 and 68 are of shallow, vertical dimensions so that these arms may fit into the gap 46 between the underside of the counter top 44 and the top 48 of the service cabinet 18, as is best seen in FIG. 2.

Figure 4:
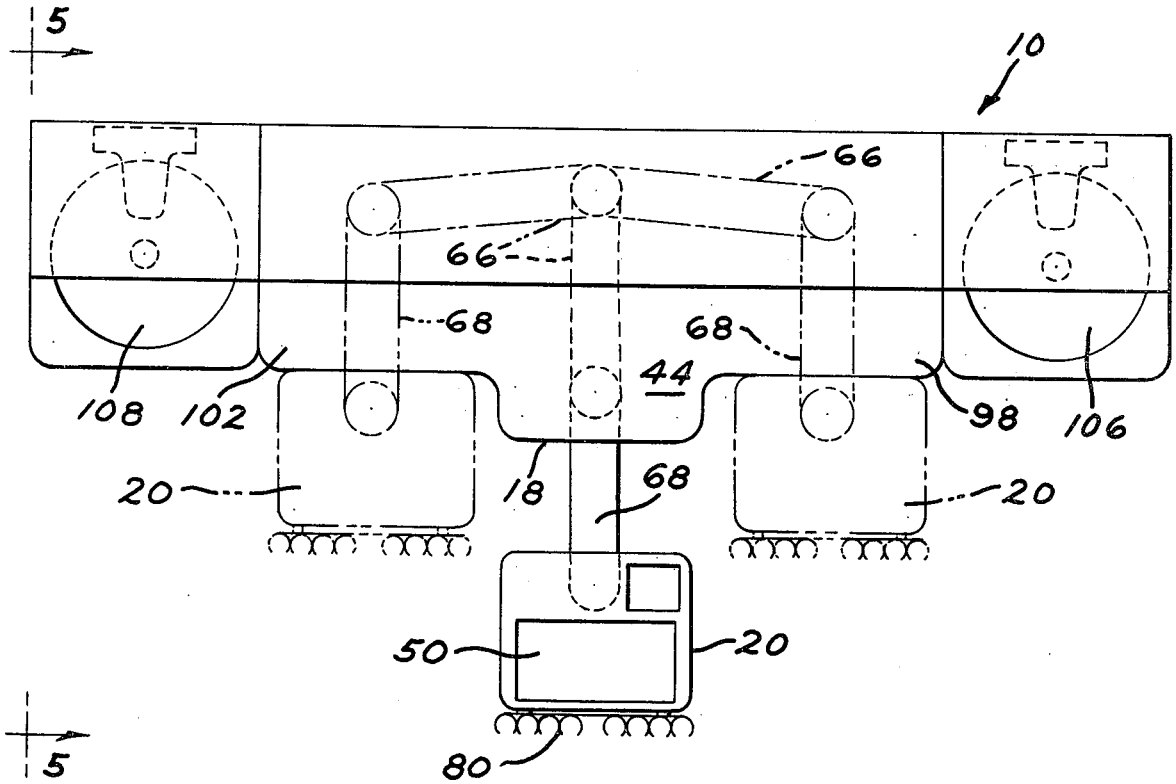
FIG. 4 is a top plan view on an enlarged scale of the dental operating unit, as is shown in FIG. 3, showing the dental assistant's unit in three possible positions: a central position in full lines, and a left- and right-hand position shown in broken lines.

Each pivoted bracket arm 66 and 68 is similar to the other, and a bottom view of each arm would show a series of open parallel channels 84, which are shown in FIG. 8 as five in number. The central channel is wider than the others because it accommodates a vacuum hose 86 which needs to be larger than the others, having a minimum diameter of about one inch. Hose 88 may be a water hose for the water nozzle 56, while the hose 90 may be a compressed air hose for the compressed air nozzle 58, and the electrical cable 92 might provide the power for the electric drill 60. Near each end of the channels 84 would be a strap 94, as is best seen in FIG. 7, for supporting these various hoses and cable within the channels on the underside of the bracket arms 66 and 68. These straps 94 may either be integral with the arm or they may be separable members that are attached by suitable fasteners (not shown). As will be well understood by those skilled in this art, extra lengths of the hoses and cable would be furnished near the central pivot means 72, 74 between the two arms 66 and 68 so that the arms may pivot relative to each other as is necessary from the right-hand view of FIG. 1 to the left-hand view of FIG. 3. FIG. 4 is a composite view, similar to that of FIGS. 1 and 3, but showing in a single view the various positions of the dental assistant's unit 20. Shown in full lines is the dental assistant's unit 20 in a central position, which is not an operating position but merely a transitory position intermediate the right-hand position shown in phantom view, similar to FIG. 1, and the left-hand position shown in phantom view, similar to FIG. 3.

Going back to the front elevational view of FIG. 2, more of a description will now be given of the overall dental operating unit 10. Notice that the counter top 44 is extended on both sides to have a right-hand section 98 to overlie an open compartment 100, and a left-hand section 102 to overlie a left-hand open compartment 104. The dental assistant's unit 20 is not adapted to be stored within this open compartment 100 or 104, as is clear from the top plan view of FIG. 4. Each side of the dental operating unit 10 is furnished with a sink unit 106 and 108 for easy access to both the doctor and the dental assistant. This is an optional feature which may or may not be provided, depending upon the preference of the operators. Similarly, there is a series of eye-level cabinets 110 which may be furnished for the storage of supplies, instruments, patient's records, etc., as is well understood by those skilled in this art.

Figure 5:
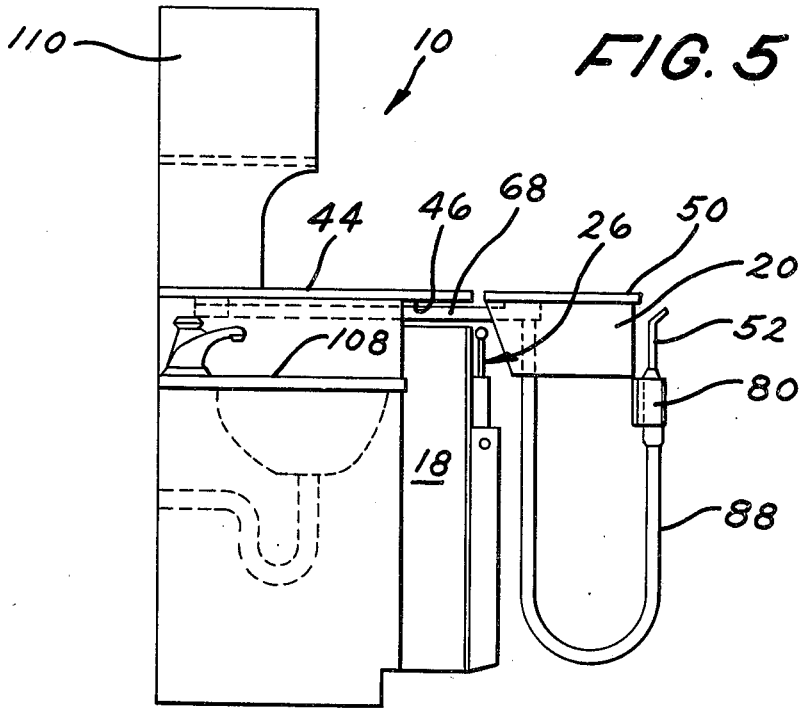
FIG. 5 is a left side, elevational view of the dental operating unit, as shown in FIG. 4, and showing the dental assistant's unit that is furnished with a series of dynamic instruments that are mounted on the front side thereof.

FIG. 5 is a left side elevational view of the dental operating unit 10, taken on the line 5—5 of FIG. 4, showing the dental assistant's unit 20 in its central transitory position of FIG. 4.

Having described above my invention of a new and original dental operating unit with a reversible dental assistant's unit, it will readily be apparent to those skilled in this art that I have discovered a universal design which will accommodate both left-handed and right-handed dentists. While I have shown a preferred embodiment of the movable support means for the dental assistant's unit, it should be understood that means other than the pair of pivoted bracket arms may be used for suspending the dental assistant's unit for movement between its left-hand and right-hand positions. A slide bar arrangement (not shown) could be established in the gap 46 so the dental assistant's unit could be shifted from left to right, while at the same time the utilities for the various dynamic instruments 52 would be capable of moving with the dental assistant's unit as the unit moves between its left- and right-hand positions.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A dental operating unit adapted for rear delivery use adjacent the head of a reclining patient's chair, said unit comprising:

a. a dentist's dynamic instrument service cabinet located at the rear of the patient's head and is accessible to the dentist as he operates from either side of the chair, said cabinet being provided with an elevated elongated counter top that extends for at least the width of the service cabinet on each side thereof thereby leaving a gap between the top of the cabinet and the underside of the counter top;

b. a reversible dental assistant's unit comprising an instrument tray and a plurality of dynamic instruments arranged on the side of the tray, said unit being supplied with one or more of the following utilities: electrical cable means, vacuum conduit means, water conduit means, and a compressed air conduit means for supplying the instruments of the assistant's unit, said unit being adapted for positioning either to the left front or the right front of the said dentist's dynamic instrument service cabinet;

c. and a pivoted bracket arm means located in the said gap between the counter top and the dynamic instrument service cabinet for swinging movement in a horizontal plane and supporting the said dental assistant's unit;

d. whereby the dental assistant's unit may be shifted anywhere between its left side and right side positions so that the dental assistant may function successfully from either side of the patient's chair, while the pivoted bracket arm means is hidden under the counter top.

2. A dental operating unit, as is recited in claim 1, wherein the said pivoted bracket arm means comprises a first pivoted arm that has an anchor pivot at one end mounted near the rear of the said dentist's dynamic instrument service cabinet just beneath the said counter top, and a second pivoted arm joined at one end to the other end of the said first pivoted arm, the other end of the said second pivoted arm being connected to the said dental assistant's unit near the rear thereof.

3. A dental operating unit, as is recited in either claims 1, or 2, wherein the said counter top extends beyond each side of the said dentist's service cabinet to form an open compartment at each side of the storage cabinet, and a sink unit positioned on the outside of each open compartment, thereby forming one closed side of each of said open compartments.

4. A dental operating unit, as is recited in either claims 1, or 3, wherein the said dental assistant's unit is suspended above the floor by the said disappearing movable support means, and the dynamic instruments of the service cabinet are positioned below the movable support means so as not to serve as an obstruction thereto.

5. A dental operating unit, as is recited in claim 1, wherein the said dental assistant's unit is capable of sliding between the said left-hand and right-hand positions in front of the said storage cabinet.

6. A dental operating unit, as is recited in claim 1, wherein the said pivoted bracket arm means are generally open at the bottom, and the said utility conduit means are strapped therein at spaced distances.

* * * * *